United States Patent [19]

Middleman et al.

[11] 4,352,083

[45] Sep. 28, 1982

[54] CIRCUIT PROTECTION DEVICES

[75] Inventors: Lee M. Middleman, Portola Valley; Joseph H. Evans; Arthur E. Blake, both of Palo Alto; Victor A. Scheff, Berkeley, all of Calif.

[73] Assignee: Raychem Corporation, Menlo Park, Calif.

[21] Appl. No.: 142,053

[22] Filed: Apr. 21, 1980

[51] Int. Cl.[3] ..... H01C 7/02; H01C 7/13

[52] U.S. Cl. ..... 338/23; 219/505; 219/548; 338/22 R; 361/106

[58] Field of Search ..... 338/22 R, 22 SD, 23, 338/24, 25; 219/548, 505; 29/611, 612, 610; 252/510–512; 361/106, 103

[56] References Cited

U.S. PATENT DOCUMENTS

| | | | |
|---|---|---|---|
| 2,978,665 | 4/1961 | Vernet et al. | 252/512 X |
| 3,243,753 | 3/1966 | Kohler | 338/22 R X |
| 3,351,882 | 11/1967 | Kohler et al. | 338/25 X |
| 3,858,144 | 12/1974 | Bedard et al. | 219/505 |
| 4,017,715 | 4/1977 | Whitney et al. | 219/548 X |
| 4,101,862 | 7/1978 | Takagi et al. | 338/22 R X |
| 4,177,376 | 12/1979 | Horsma et al. | 338/22 R X |
| 4,177,446 | 12/1979 | Diaz | 338/212 |
| 4,200,973 | 5/1980 | Farkas | 338/22 SD |
| 4,259,657 | 3/1981 | Ishikawa | 338/22 R |

FOREIGN PATENT DOCUMENTS

| | | | |
|---|---|---|---|
| 1016353 | 9/1957 | Fed. Rep. of Germany . | |
| 259272 | 10/1926 | United Kingdom . | |
| 1242549 | 8/1971 | United Kingdom . | |
| 1466004 | 3/1977 | United Kingdom . | |
| 2024577 | 1/1980 | United Kingdom . | |
| 2024579 | 1/1980 | United Kingdom | 219/549 |
| 2052228 | 1/1981 | United Kingdom . | |

*Primary Examiner*—C. L. Albritton
*Attorney, Agent, or Firm*—Lyon & Lyon

[57] ABSTRACT

Circuit protection devices which comprise two columnar electrodes and a conductive polymer element, at least a part of which is a PTC element. The device is so constructed that if a hot zone forms in the PTC element when current is passed through the device, it forms at a location away from the electrodes, thus increasing the useful life of the device. In one preferred embodiment, the conductive polymer element has an intermediate portion of increased resistance, thus causing the hot zone to be located at or near the intermediate portion. The intermediate portion may be of reduced size and/or be composed of conductive polymer of relatively high resistivity.

32 Claims, 31 Drawing Figures

CIRCUIT PROTECTION DEVICES

BACKGROUND OF THE INVENTION

1. Field of the Invention

This invention relates to circuit protection devices which comprise conductive polymer PTC elements.

2. Summary of the Prior Art

Conductive polymer PTC compositions are well known, and for details of recent developments relating to such compositions and devices comprising them, reference may be made for example to U.S. Pat. Nos. 4,017,715 (Whitney et al.), 4,177,376 (Horsma et al.) and U.S. Ser. Nos. 608,660 (Kampe) now abandoned, 750,149 (Kamath et al.) now abandoned, 732,792 (Van Konynenburg et al.) now abandoned, 751,095 (Toy et al.) now abandoned, 798,154 (Horsma et al.) now abandoned, 873,676 (Horsma) now U.S. Pat. No. 4,246,468, 965,343 (Van Konynenburg et al.) now U.S. Pat. No. 4,237,441, 965,344 (Middleman et al) now U.S. Pat. Nos. 4,238,812, 965,345 (Middleman et al.) now abandoned, 6,773 (Simmon) now U.S. Pat. No. 4,255,698, 41,071 (Walker) now U.S. Pat. No. 4,272,471, and 98,711 (Middleman et al). It has been proposed to use devices comprising PTC elements to protect circuits against fault conditions arising from excessive temperatures and/or circuit currents—see for example U.S. Pat. Nos. 2,978,665 (Vernet et al.), 3,243,753 (Kohler) and 3,351,882 (Kohler), U.K. Pat. No. 1,534,715, the article entitled "Investigations of Current Interruption by Metal-filled Epoxy Resin" by Littlewood and Briggs in J. Phys. D: Appl. Phys, Vol. II, pages 1457–1462, and the article entitled "The PTC Resistor" by R. F. Blaha in Proceedings of the Electronic Components Conference, 1971, and the report entitled "Solid State Bistable Power Switch Study" by H. Shulman and John Bartho (August 1968) under Contract NAS-12-647, published by the National Aeronautics and Space Adminstration. However, it is only very recently, as described in U.S. Ser. Nos. 965,344 (Middleman et al.) and 6,773 (Simon), that circuit protection devices comprising conductive polymer PTC elements have become a practical reality.

The disclosure of each of the patents, patent applications are publications referred to above is incorporated by reference herein.

A problem which arises in the use of electrical heaters comprising PTC elements is that when a PTC element is heated by passage of current through it to a temperature at which it is self-regulating, a very large proportion of the voltage drop over the PTC element nearly always takes place over a very small proportion of the element. This small proportion is referred to herein as a "hot zone," and is referred to in the prior art as a "hot line." As discussed in U.S. Pat. No. 4,177,376 (Ser. No. 601,638), the result of hot zone formation, especially in heaters which comprise wire electrodes joined by a strip of PTC material, is that the heater is less efficient. U.S. Pat. No. 4,177,376 describes electrical devices, especially heaters, which comprise a layer of a PTC material with a contiguous layer of constant wattage (or ZTC) material, so that the hot zone is of greater area at right angles to the direction of current flow.

U.S. Pat. No. 3,351,882 (Kohler) discloses electrical resistors comprising a PTC conductive polymer element which has end portions of relatively large cross-sectional area and a constricted intermediate portion of relatively small cross-section, and generally planar electrodes of substantial cross-sectional area (typically of "meshed" construction) embedded in the end portions of the PTC element; the PTC element is cross-linked at least around the electrodes. The stated object of using such electrodes is to provide a relatively low and uniform current density around the electrodes and thus avoid the localized overheating which occurs with other type of electrode, causing deterioration of the PTC material and undesirable variations of the paths of current flow. The stated object of having a constricted intermediate portion in the PTC element is to ensure that the end portions will not reach the critical temperature (at which the PTC conductive polymer increases sharply in resistivity) because the greater current density in the intermediate portion results in the intermediate portion first reaching the critical temperature and thus reducing the current through the resistor.

SUMMARY OF THE INVENTION

In further developing circuit protection devices comprising conductive polymer PTC elements, we have recognized that although there are many circumstances in which it is advantageous to use planar electrodes of the kind generally described in U.S. Pat. No. 3,351,882 and Ser. No. 965,344 (Middleman et al) now U.S. Pat. No. 4,238,812, the use of generally columnar electrodes (e.g. wires) does not necessarily suffer from the disadvantages taught by Kohler but to the contrary can result in circuit control devices which in many circumstances have substantial advantages over devices containing generally planar electrodes, providing that measures are taken to ensure that when a hot zone is formed in the PTC element, it is formed at a location away from the electrode, preferably separated therefrom by a distance greater than that which can be bridged by an arc at the voltage and current applied in the fault condition of the circuit. The preferred method of ensuring a suitable location of the hot zone is to provide a conductive polymer element between the electrodes which has an intermediate section which, by reason of its relatively high electrical resistance and/or relatively low ability to dissipate heat, increases in temperature, when the current through the device is increased rapidly from a level at which the PTC element is in a low temperature, low resistance state to a level which converts the PTC element into a high temperature, high resistance state, at a rate greater than another section of the element. IF the intermediate section comprises a part of the PTC element, then the hot zone will be formed in the intermediate section itself. Otherwise, the hot zone will be formed in the part of the PTC element which is closest to the intermediate section.

In one embodiment, the invention provides a circuit protection device whose largest dimension is less than 12 inches, which has a resistance at 23° C. of less than 100 ohms and which comprises (1) a conductive polymer element, at least a part of which is a PTC element, and (2) two electrodes, at least one of which has an electrically active surface of a generally columnar shape, and which can be connected to a source of electrical power and, when so connected, cause current to flow through said PTC element;

said device being such that, if the portion thereof between the electrodes is divided into parallel-faced slices, the thickness of each slice being about 1/10 of the distance between the closest points of the two electrodes and the faces of the slices being planes which are perpendicular to a line joining the closest points of the two electrodes, then there is at least one Type A slice which comprises a part of the PTC element and at least one Type B slice whose thermal and electrical characteristics are such that, when the current through the device is increased rapidly from a level at which the PTC element is in a low temperature, low resistance state to a level which converts the PTC element into a high temperature, high resistance state, the conductive polymer element in the Type B element increases in temperature at a rate which is greater than the rate at which the PTC element in the Type A slice increases in temperature;

subject to the proviso that neither of the slices adjacent an electrode is a Type B slice which comprises a part of the PTC element in contiguity with the electrode.

In another embodiment the invention provides an electrical circuit which comprises (a) a source of electrical power;

(b) an electrical load; and (c) a circuit protection device as defined above whose resistance at 23° C. is less than 5% of the total resistance of the circuit at 23° C.

BRIEF DESCRIPTION OF THE DRAWINGS

The invention is illustrated in the accompanying drawings, in which.

DETAILED DESCRIPTION OF THE INVENTION

Figure 1A:
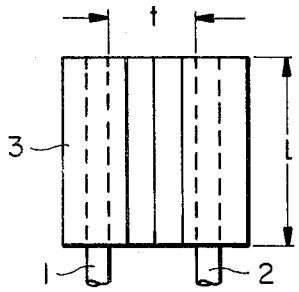
FIGS. 1a–9c show devices of the invention in side (FIGS. 1A, 2A etc.), end (FIGS. 1B, 2B etc.) and plan (FIGS. 1C, 2C etc.) views.

The term "electrically active surface" of an electrode is used herein to denote the surface of the electrode through which current flows when current is passed through the device.

The term "effective surface area" or "ESA" of an electrode is used herein to denote the cross-sectional area of the electrode when viewed in the direction of current flow (ignoring any apertures in the electrode which are sufficiently small for the electrode to provide a substantially equipotential surface over its total area).

The term "inter-electrode distance," t, is used herein to denote the shortest geometric distance between two electrodes.

The width of an electrode, w, is defined herein as the smallest dimension of the ESA. The length of an electrode, l, is defined herein as the largest dimension of the ESA. An electrode having an ESA of a generally columnar shape is defined herein as one having a l/w ratio of at least 3:1, preferably at least 5:1, and often substantially more, e.g. at least 8:1, at least 10:1, at least 12:1 or at least 15:1.

The electrodes in the devices of the present invention may have one or more of the following characteristics.

(a) They are composed of a material having a resistivity of less than $10^{-4}$ ohm.cm and have a thickness such that they do not generate significant amount of heat during operation of the device. The electrodes are typically composed of a metal, nickel or nickel-plated electrodes being preferred.

(b) They are in the form of wires or thin strips, preferably of the same dimensions and parallel to each other, and preferably completely embedded in the PTC element. Such electrodes may for example have an ESA of 0.01 to 0.1 inch$^2$, l from 0.3 to 1 inch and w from 0.02 to 0.1 inch.

(c) They are in physical (as well as electrical) contact with the PTC element, or separated therefrom by a layer of another conductive material, e.g. a layer of a relatively constant wattage conductive polymer composition.

The PTC element in the devices of the present invention is composed of a PTC conductive polymer composition, preferably one in which the conductive filler comprises carbon black or graphite or both, especially one in which carbon black is the sole conductive filler, especially a carbon black having a particle size, D, which is from 20 to 90 millimicrons and a surface area, S, in $M^2/g$ such that S/D is not more than 10. The resistivity of the PTC composition at 23° C. will generally be less than 100 ohm.cm, especially less than 10 ohm.cm. The composition may be cross-linked or substantially free from cross-linking. Suitable PTC compositions are disclosed in the prior art. The PTC element may be of uniform composition throughout, or it may comprise segments of different composition, as further explained below. Particularly suitable PTC compositions are disclosed in the commonly assigned and contemporaneously filed application Ser. No. 141,989, of Evans, the disclosure of which is incorporated by reference herein.

When the conductive polymer element comprises not only a PTC element but also a constant wattage (CW) element of a conductive polymer exhibiting ZTC behavior, the ZTC conductive polymer can be any of those disclosed in the prior art, preferably one which is compatible with the PTC composition.

The devices of the present invention have a resistance at 23° C. of less than 100 ohms, preferably less than 50 ohms, and may for example have a resistance of 0.1 to 25 ohms. For practical use as a circuit protection device, the size of the device, including any oxygen barrier around the conductive polymer element and the electrodes, is an important consideration. The largest dimension of the device is less than 12 inches, and usually much less, e.g. less than 8 inches, preferably less than 5 inches, especially less than 3 inches, particularly less than 2 inches.

In order to achieve the desired location of the hot zone away from the electrodes, different parts of the conductive polymer element should have different thermal responses to an increase in current which causes the device to trip (i.e. be converted into a high temperature, high resistance state). Furthermore, the part of the conductive element which increases most rapidly in temperature under these circumstances should not be one which comprises a part of the PTC element in contact with an electrode (since the hot zone will then be formed adjacent the electrode). In most cases, a device which shows the desired characteristics, when the device is caused to trip by an increase in current, will also show a qualitatively similar thermal response when the device at 23° C. is first connected to a source of electrical power.

In defining the devices of the invention, reference is made to dividing the portion thereof between the electrodes into ten slices of equal thickness. It should be understood that, although the possibility of physically slicing a device is not excluded as a technique for determining whether a particular device falls within the definition, the division of the device into slices can be a notional one, with the thermal response of each slice being determinable, either before or after tripping or both, from a knowledge of how the device was made and/or from the results of other, more simply effected tests such as physical division of the device along one or a limited number of planes. In preferred devices of the invention, there is a Type A slice and a Type B slice when the portion of the device between the electrodes is divided into a number of slices (of equal thickness) which is less than 10, e.g. 8, 5 or 3.

It should also be understood that a given slice of the device may be a Type A slice relative to one slice (of Type B) but a Type B slice relative to another slice (of Type A). This is further discussed below in relation to FIG. 11. The proviso that neither of the slices adjacent to an electrode is a Type B slice which comprises a part of the PTC element in contiguity with the electrode means that neither of these slices should be a Type B slice relative to any of the other slices (of Type A).

Although the devices preferably contain two electrodes, they can contain more than two. Preferably both electrodes are columnar, but one can be columnar and the other having an electrically active surface which is planar or bent around the electrode, e.g. cylindrical or part cylindrical. In the latter case the notional slices should be cut from thin sectors from the columnar electrode to the bent electrode.

There are a number of different ways, which can be used alone or in combination, for producing a Type B slice.

A preferred method is for the Type B slice to have a face-to-face resistance at 23° C. which is greater than, preferably at least 1.2 times, especially at least 1.5 times, the face-to-face resistance of the Type A slice. This can be achieved, for example, in the following ways:

(1) The conductive polymer element has an intermediate portion of reduced cross-section, by reason of an external restriction (so that the volume enclosed by the periphery of the element in the Type B slice is less than the volume enclosed in the Type A slice) and/or by reason of one or more internal portions which comprise a material having a resistivity at 23° C. higher than the conductive polymer, e.g. a portion which is substantially non-conducting when current is passed through the device for example one composed of air or another electrical insulator, or a wire having an insulating coating thereon. A fabric composed of an insulating material and having openings therein can be used for this purpose. In this embodiment, the area occupied by conductive polymer in at least one cross-section through the Type B slice, parallel to the face, is not more than the ESA of at least one of the electrodes.

(2) The conductive polymer element comprises an intermediate portion composed of a material of higher resistivity than the remainder. The intermediate portion can be of PTC material or ZTC material.

(3) The conductive polymer element has a first PTC section in contact with one electrode and a second ZTC section in contact with the other electrode, the ZTC material being of higher resistivity at 23° C. than the PTC material.

Another preferred method is for the periphery of the conductive element in the Type B slice to be more efficiently thermally insulated than the periphery of the conductive polymer element in the Type A slice. This can be achieved for example by placing thermally insulating material around a central portion of the device and/or by placing cooling means, e.g. fins, in the vicinity of one or both of the electrodes.

A similar method is for the Type B slice to comprise heating means which may be independent of the $I^2R$ heating of the conductive polymer element by passage of current therethrough between the electrodes.

There is a wide range of devices which make use of the principle of this invention. In many, but by no means all of them, the principal current flow, when the device is connected to a source of electrical power with the device at 23° C., lies in the plane which includes the closest points of the two electrodes.

Figure 2A:
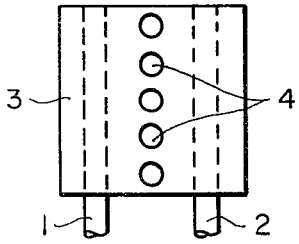
Figure 2B:
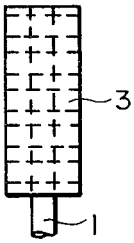
Figure 2C:
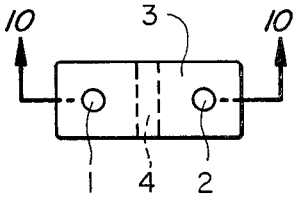
Figure 3A:
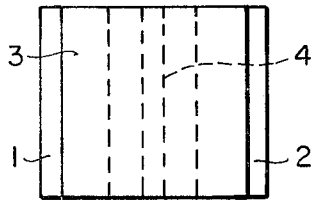
Figure 3B:
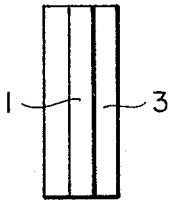
Figure 3C:
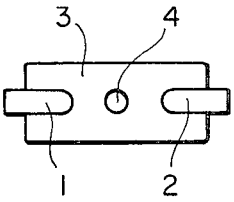
Figure 4A:
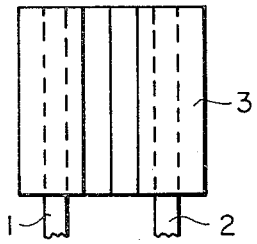
Figure 4B:
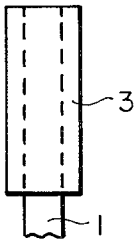
Figure 4C:
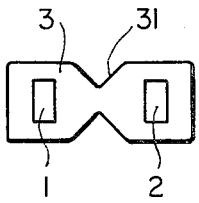
Figure 5A:
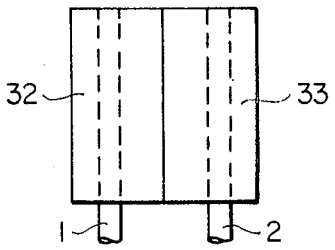
Figure 5B:
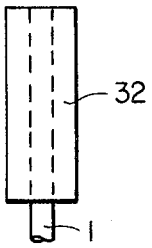
Figure 5C:
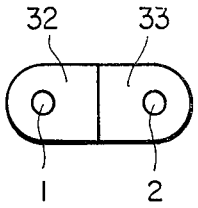
Figure 6A:
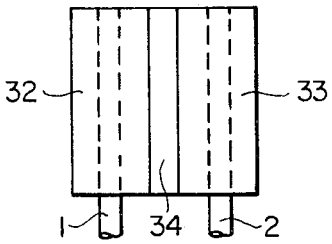
Figure 6B:
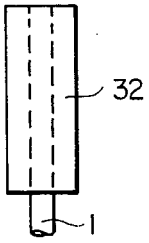
Figure 6C:
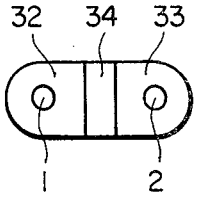
Figure 7A:
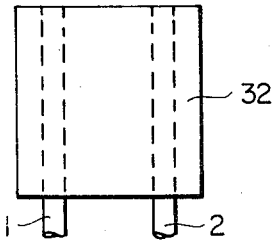
Figure 7B:
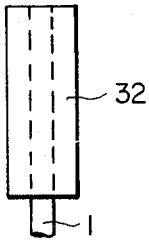
Figure 7C:
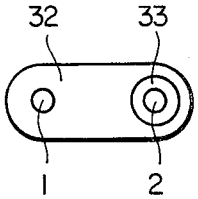
Figure 8A:
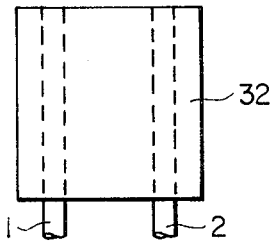
Figure 8B:
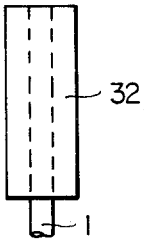
Figure 8C:
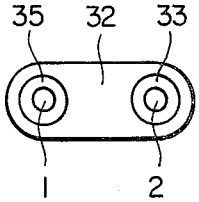
Figure 9A:
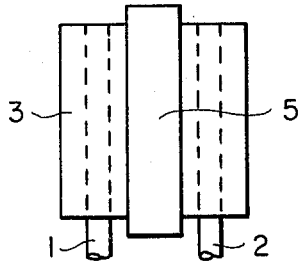
Figure 9B:
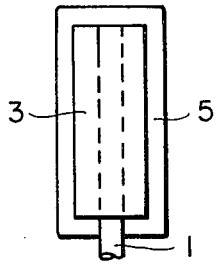
Figure 9C:
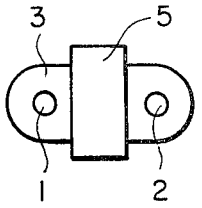

Referring now to the Figures, these all show devices comprising two columnar electrodes 1 and 2. In FIGS. 1 to 4, the electrodes are connected by a PTC element 3 of uniform composition which has a central section of reduced cross-section by reason of an external restriction 31 (FIGS. 1 and 4) or internal void(s) 4 (FIGS. 2 and 3). FIGS. 5 to 8 show conductive elements which have at least two sections of different resistivity materials. In FIG. 5, PTC section 32 is composed of a PTC material having a first resistivity and CW section 33 is composed of a ZTC material having a second resistivity which is higher than the first resistivity. In FIG. 6, the electrodes are embedded in PTC elements 32 and 33 (of the same or different materials) and there is a central section 34 which is of PTC or ZTC material of higher resistivity than the material in 32 or 33. In FIG. 7, electrode 2 is surrounded by a layer 33 of ZTC material and PTC element 32 is composed of a PTC material of lower resistivity than the ZTC material. In FIG. 8, both electrodes are surrounded by layers 33, 35 of ZTC material and PTC element 32 is composed of a PTC material of lower resistivity than the ZTC material. FIG. 9 shows a PTC element 3 of uniform composition and cross-section (between the electrodes) whose central portion is surrounded by thermally insulating or heating means 5.

Figure 10A:
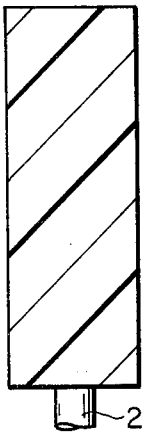
FIG. 10 is a cross-section of the device of FIG. 2 taken along the line 10—10 of FIG. 2C, and FIGS. 10a and 10b show cross-sections taken along line A—A and B—B of FIG. 10.
Figure 10:
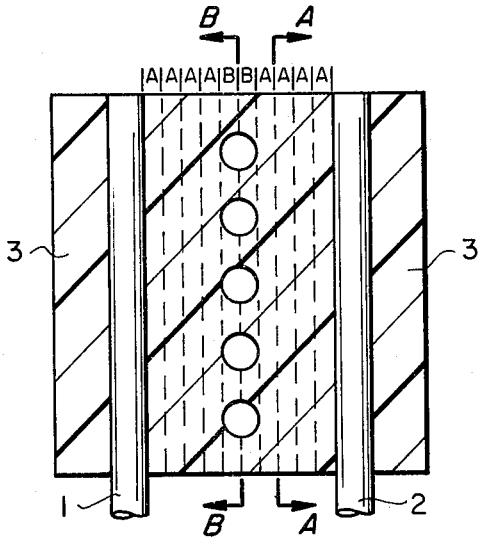
Figure 10B:
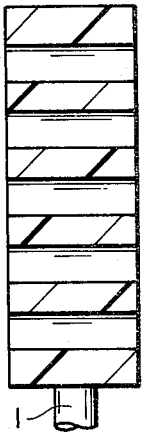

FIG. 10 shows a cross-section through the device of FIG. 2, showing how the conductive polymer element is divided into Type A and Type B slices, and FIGS. 10A and 10B show cross-sections of the Type A and B slices.

Figure 1B:
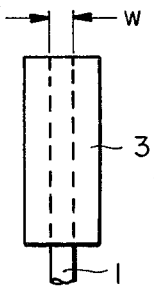
Figure 1C:
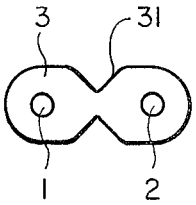
Figure 11:
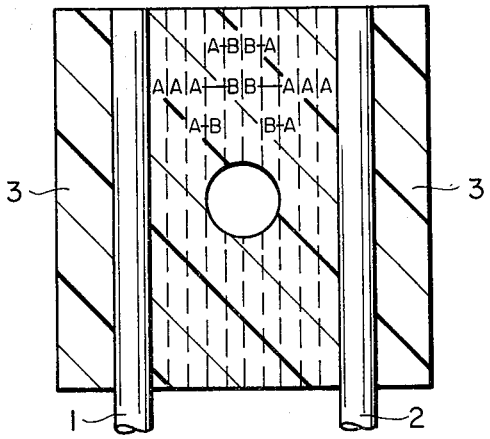
FIG. 11 is a cross-section through another device.

FIG. 11 shows a cross-section through a device similar to that shown in FIG. 1 but having a single large hole through the middle of the PTC element, showing how, when the device is divided into slices, a slice may be of Type A in relation to one slice and of Type B in relation to another.

Circuit protection devices which will provide repeated protection against sudden increases in current to high levels and which can make use of the present invention are described in the commonly assigned and contemporaneously filed application Ser. No. 141,987 of Middleman et al. entitled Circuit Protection Devices Comprising PTC Elements, the disclosure of which is incorporated by reference herein.

Many of the measures disclosed herein for locating the hot zone away from the electrodes are also novel and useful in other PTC electrical devices including heaters.

We claim:

1. A circuit protection device whose largest dimension is less than 12 inches, which has a resistance at 23° C. of less than 100 ohms and which comprises (1) a conductive polymer element, at least a part of which is a PTC element, and (2) two electrodes, at least one of which has an electrically active surface of a generally columnar shape, and which can be connected to a source of electrical power and, when so connected, cause current to flow through said PTC element;

said device being such that, if the portion thereof between the electrodes is divided into parallel-faced slices, the thickness of each slice being about 1/10 of the distance between the closest points of the two electrodes and the faces of the slices being planes which are perpendicular to a line joining the closest points of the two electrodes, then there is at least one Type A slice which comprises a part of the PTC element and at least one Type B slice whose thermal and electrical characteristics are such that, when the current through the device is increased rapidly from a level at which the PTC element is in a low temperature, low resistance state to a level which converts the PTC element into a high temperature, high resistance state, the Type B slice increases in temperature at a rate which is greater than the rate at which the PTC element in the Type A slice increases an temperature;

subject to the proviso that neither of the slices adjacent an electrode is a Type B slice which comprises a part of the PTC element in contiguity with the electrode.

2. A device according to claim 1 wherein each of said electrode has an electrically active surface of a generally columnar shape and said Type B slice has a higher face-to-face resistance at 23° C. than said Type A slice.

3. A device according to claim 2 wherein the face-to-face resistance of said Type B slice is at least 1.2 times the face-to-face resistance of said Type A slice.

4. A device according to claim 2 wherein the conductive polymer in the Type A slice has substantially the same resistivity as the conductive polymer in the Type B slice.

5. A device according to claim 4 wherein the conductive polymers in the Type A and Type B slices are the same.

6. A device according to claim 5 wherein the volume enclosed by the periphery of the conductive polymer element in the Type B slice is less than the volume enclosed by the periphery of the conductive polymer element in the Type A slice.

7. A device according to claim 6 wherein the area occupied by conductive polymer in at least one of the faces of the Type B slice is less than the effective surface area of at least one of the electrodes.

8. A device according to claim 5 wherein the Type B slice comprises, within the periphery of the conductive polymer element, at least one first portion composed of a conductive polymer and at least one second portion comprising a material having a resistivity at 23° C. higher than said conductive polymer.

9. A device according to claim 8 wherein said second portion is substantially non-conducting when current is passed through the device at 23° C.

10. A device according to claim 9 wherein the second portion is composed of an insulating material.

11. A device according to claim 2 wherein said conductive polymer element consists essentially of said PTC element.

12. A device according to claim 2 wherein said conductive polymer element including an element composed of conductive polymer exhibiting ZTC behavior.

13. A device according to claim 12 wherein the resistivity at 23° C. of said conductive polymer exhibiting ZTC behavior is higher than the resistivity at 23° C. of said conductive polymer exhibiting PTC behavior.

14. A device according to claim 1 wherein the periphery of the conductive polymer element in the Type B slice is more efficiently thermally insulated than the periphery of the conductive polymer element in the Type A slice.

15. A device according to claim 1 wherein each of said electrodes has an electrically active surface of a generally columnar shape and the principal current flow, when the electrodes are first connected to a source of electrical power with the device at 23° C. lies in the plane which includes the closest points of the two electrodes.

16. A device according to claim 1 wherein the Type B slice comprises heating means which is independent of the conductive polymer element.

17. An electrical circuit which comprises (a) a source of electrical power;

(b) an electrical load; and (c) a circuit protection device whose resistance at 23° C. is less than 100 ohms and less than 5% of the total resistance of the circuit at 23° C., whose largest dimension in less than 12 inches and which comprises (1) a conductive polymer element, at least a part of which is a PTC element, and (2) two electrodes, at least one of which has an electrically active surface of a generally columnar shape, and which can be connected to a source of electrical power and, when so connected, cause current to flow through said PTC element;

said device being such that, if the portion thereof between the electrodes is divided into parallel-faced slices, the thickness of each slice being about 1/10 of the distance between the closest points of the two electrodes and the faces of the slices being planes which are perpendicular to a line joining the closest points of the two electrodes, then there is at least one Type A slice which comprises a part of the PTC element and at least one Type B slice whose thermal and electrical characteristics are such that, when the current through the device is increased rapidly from a level at which the PTC element is in a low temperature, low resistance state to a level which converts the PTC element into a high temperature, high resistance state, the Type B slice increases in temperature at a rate which is greater than the rate at which the PTC element in the Type A slice increases in temperature;

subject to the proviso that neither of the slices adjacent an electrode is a Type B slice which comprises a part of the PTC element in contiguity with the electrode.

18. A circuit according to claim 17 wherein each of said electrodes has an electrically active surface of a generally columnar shape and said Type B slice has a higher face-to-face resistance at 23° C. than said Type A slice.

19. A circuit according to claim 18 wherein the face-to-face resistance of said Type B slice is at least 1.2 times the face-to-face resistance of said Type A slice.

20. A circuit according to claim 18 wherein the conductive polymer in the Type A slice has substantially the same resistivity as the conductive polymer in the Type B slice.

21. A circuit according to claim 20 wherein the conductive polymers in the Type A and Type B slices are the same.

22. A circuit according to claim 21 wherein the volume enclosed by the periphery of the conductive polymer element in the Type B slice is less than the volume enclosed by the periphery of the conductive polymer element in the Type A slice.

23. A circuit according to claim 22 wherein the area occupied by conductive polymer in at least one of the faces of the Type B slice is not more than the effective surface area of at least one of the electrodes.

24. A circuit according to claim 21 wherein the Type B slice comprises, within the periphery of the conductive polymer element, at least one first portion composed of a conductive polymer and at least one second portion comprising a material having a resistivity at 23° C. higher than said conductive polymer.

25. A circuit according to claim 24 wherein said second portion is substantially non-conducting when current is passed through the device at 23° C.

26. A circuit according to claim 25 wherein the second portion is composed of an insulating material.

27. A circuit according to claim 18 wherein said conductive polymer element consists essentially of said PTC element.

28. A circuit according to claim 18 wherein said conductive polymer element includes an element composed of conductive polymer exhibiting ZTC behavior.

29. A circuit according to claim 28 wherein the resistivity at 23° C. of said conductive polymer exhibiting ZTC behavior is higher than the resistivity at 23° C. of said conductive polymer exhibiting PTC behavior.

30. A circuit according to claim 17 wherein the periphery of the conductive polymer element in the Type B slice is more efficiently thermally insulated than the periphery of the conductive polymer element in the Type A slice.

31. A circuit according to claim 17 wherein each of said electrodes has an electrically active surface of a generally columnar shape and the principal current flow, when the electrodes are first connected to a source of electrical power with the device at 23° C., lies in the plane which includes the closest points of the two electrodes.

32. A circuit according to claim 17 wheren the Type B slice comprises heating means which is independent of the $I^2R$ heating of the conductive polymer element by passage of current therethrough between the electrodes.

* * * * *